United States Patent [19]

Roda

[11] Patent Number: 4,702,495

[45] **Date of Patent: * Oct. 27, 1987**

[54] SKI POLE RECEIVER

[76] Inventor: Gary E. Roda, 367 Rugby Ave., Berkeley, Calif. 94708

[ * ] Notice: The portion of the term of this patent subsequent to Dec. 23, 2003 has been disclaimed.

[21] Appl. No.: 893,732

[22] Filed: Aug. 6, 1986

Related U.S. Application Data

[63] Continuation-in-part of Ser. No. 761,693, Aug. 2, 1985, Pat. No. 4,630,842.

[51] Int. Cl.[4] ..... A63C 11/02

[52] U.S. Cl. ..... 280/814; 224/917; 294/147; 403/334

[58] Field of Search ..... 280/809, 814, 816; 224/185, 270, 917; 294/15, 143, 147; 403/334

[56] References Cited

U.S. PATENT DOCUMENTS

| | | | |
|---|---|---|---|
| 2,106,037 | 1/1938 | Pirich | 403/334 X |
| 2,340,868 | 2/1944 | Dye | 280/814 X |
| 3,377,095 | 4/1968 | Allen | 294/15 |
| 3,549,065 | 12/1970 | Schubert | 294/143 |
| 3,714,803 | 2/1973 | Chenenko | 280/814 |
| 3,727,934 | 4/1973 | Averbook et al. | 280/814 |
| 4,519,625 | 5/1985 | Luitz et al. | 280/617 X |

FOREIGN PATENT DOCUMENTS

| | | | |
|---|---|---|---|
| 2214104 | 9/1973 | Fed. Rep. of Germany | 224/917 |
| 226705 | 4/1943 | Switzerland | 280/814 |

*Primary Examiner*—John J. Love
*Assistant Examiner*—Michael Mar
*Attorney, Agent, or Firm*—H. Michael Brucker

[57] ABSTRACT

A device for carrying snow skis wherein a ski tip receiver is permanently secured at the upper surface of a snow ski defining a tapered cylindrical space sized to receive and grip a ski pole tip and oriented to permanently align the cylindrical space perpendicular to the length to the ski such that when a ski pole tip is inserted into the cylindrical space, the ski pole will be disposed perpendicular to the length of the ski. The invention permits skis to be carried by inserting a ski pole tip in each ski tip receiver, hoisting the ski poles on a skier's shoulder to align the skis vertically along, and spaced from, the back of the skier, and secure and steady the skis by gripping the ski poles with a hand.

4 Claims, 8 Drawing Figures

SKI POLE RECEIVER

This is a continuation-in-part of my co-pending application, Ser. No. 761,693, filed Aug. 2, 1985 for METHOD AND APPARATUS FOR CARRYING SNOW SKIS now U.S. Pat. No. 4,630,842.

BACKGROUND OF THE INVENTION

The present invention relates to apparatus for carrying snow skis using ski poles.

Because of their length and weight, snow skis when not being worn by a skier are cumbersome items to carry at best and when being transported in and about a ski area potentially dangerous instrumentalities.

By far the most common method for carrying skis is to secure the skis together, (running surface to running surface) and hoist the skis onto the skier's shoulder where they are secured and balanced by the skier's hand. The other hand is normally used to carry ski poles and any other equipment then being transported. While this method is the most popular, it is also very dangerous. The shouldered skis extend outwardly behind and partially out of sight of the skier while the skier is likely walking on a snow or ice covered surface, wearing boots which are not designed for walking and while generally unbalanced by the weight of the skis and the lack of use of the pole-carrying hand. If the skier slips or simply turns, anyone within the radius of the ski tips will be likely hit, generally above the neck.

A number of devices are known and marketed which attach to a pair of skis and provide a handle which permit the skis to be carried as one would carry a suitcase. These devices often include securing means for the ski poles as well, or use of the poles as part of the handle and thus permit skis and poles to be carried in one hand. These devices have not found widespread use, however, because they must be removed from the skis and stowed separately from the skis while the skis are in use. This requires either that the device be carried in a backpack or similar carrying device on the skier or be put in a locker or some other secure place. Because of this inconvenience and proliferation of gear, the vast majority of skiers have not embraced these ski carrying devices but instead persist in the more convenient but at the same time more dangerous method of carrying their skis over their shoulder. Both the shoulder carry method and the devices which provide a suitcase-like carrying handle for skis have the further disadvantage of placing the skis in a generally horizontal position perpendicular to the skier. The carrying devices have the advantage of locating the skis at knee level rather than head level, but they still place the ski ends some distance from the skier and in position to easily strike other skiers.

Another method that some skiers use to avoid the disadvantages cited above, is to slide a ski pole under the toe binding of each ski (while the skis are secured running surface to running surface) and hoist the poles onto a shoulder thereby disposing the skis generally vertical along the skier's back. This method, however, works only with those models of toe bindings having enough space to receive the shank of a ski pole and even for those bindings there are two serious drawbacks. First, the skis tend to ride down the poles and rest against and possibly soil the skier's garments, and second, the bindings are subject to forces that can cause damage to them or change their adjustment. Because of these drawbacks, this carrying method is rarely seen in practice.

A number of devices are known in the prior art for attachment to skis to assist in securing the skis against theft when not in use such as shown in the patent to Averbook, U.S. Pat. No. 3,727,934. As in Averbook, devices of this description are not sized relative to a ski pole tip as is required in the present invention as more fully set forth hereinbelow and thus are not useful to assist in the caring of skis by using the ski pole tips.

Since few skiers have the strength to simply carry their skis in one hand maintaining the skis in a generally vertical direction (the safest way to carry skis), the shoulder carry is ultimately resorted to giving rise to all of the dangers mentioned above. It is an object of the present invention to provide an accessory for a snow ski which is permanently attached to the ski and which makes it possible to employ a carry method by which the skis are conveniently carried in a generally vertical position with both the skis and ski poles in one hand wherein the skis cannot slide down the poles and wherein no potentially damaging forces are applied to the bindings.

BRIEF DESCRIPTION OF THE INVENTION

The present invention teaches means by which snow skis secured together (running surface to running surface) are secured to the tips of a pair of ski poles in such a manner that when the ski poles are placed on the skiers shoulder, the skis are disposed in a generally vertical position parallel to and spaced from the skier's back. The invention contemplates attaching to each of a pair of snow skis a ski pole tip receiver that defines a cylindrical space sized to receive ski pole tips and oriented such that the axis of the cylindrical space is permanently fixed generally perpendicular to the longitudinal axis of the skis and parallel to the skis upper surface so that the ski poles will be generally perpendicular to the length of the skis when the pole tips are inserted into the receiver. Since the receiver is small and permanently secured to the skis, id does not comprise additional "gear" which must be accounted for separate from the skis themselves.

DETAILED DESCRIPTION OF THE INVENTION

Figure 1:
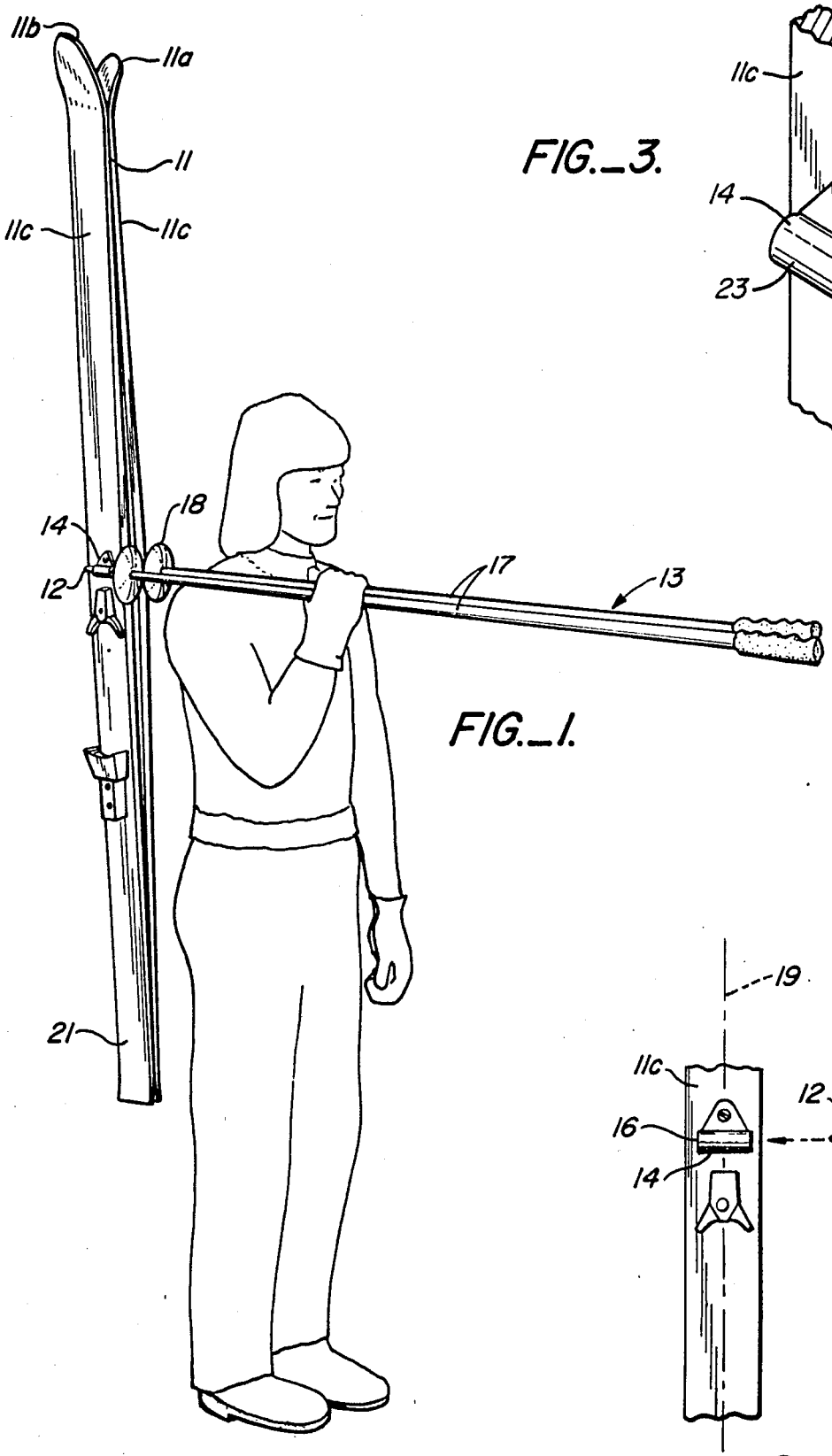
FIG. 1 is an isometric view showing a skier carrying a pair of snow skis using the ski pole tip receiver of the present invention.

Referring to FIG. 1, a skier is illustrated carrying a pair of snow skis 11 using tip receiver means 14 of the present invention. The skis which have been secured together running surface 11*a* to running surface 11*b* and are disposed generally vertical and parallel to and spaced from the skier's back by means of the tips 12 (only one of which is shown) of ski poles 13 being inserted into ski pole tip receiver means 14 (only one of which is shown) of the present invention attached to the upper surfaces 11*c* of the skis 11 and the pole shafts 17 disposed on the skier's shoulder. The skis are secured and steadied by gripping the pole shanks with a hand.

Figure 3:
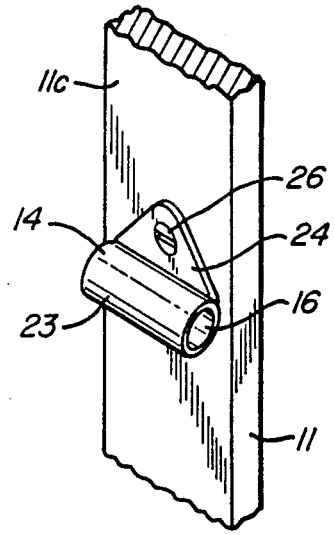
FIG. 3 is an isometric view of one embodiment of the present invention shown in connection with a portion of a ski to which it is attached.
Figure 2:
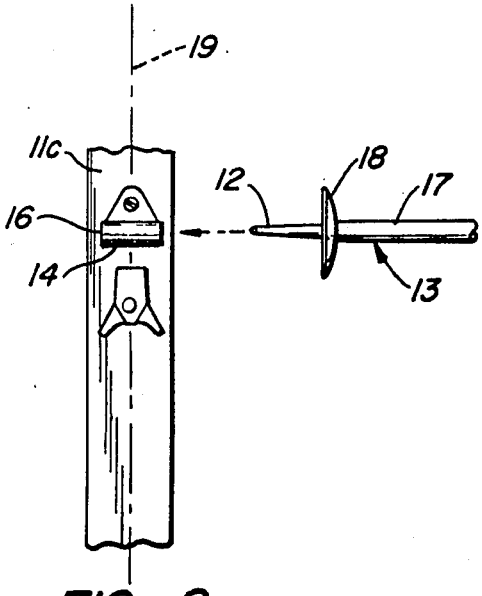
FIG. 2 is a plan view of a portion of a ski on which a receiver of the present invention has been mounted shown with a portion of a ski pole showing how the tip of the ski pole interacts with the present invention.
Figure 4:
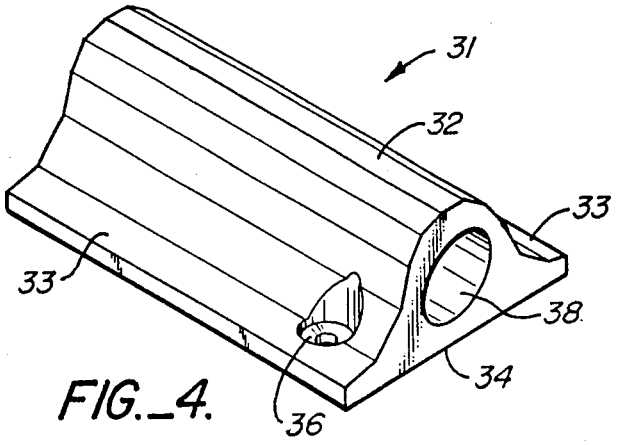
FIG. 4 is an isometric view of an alternative embodiment of the present invention.
Figure 5:
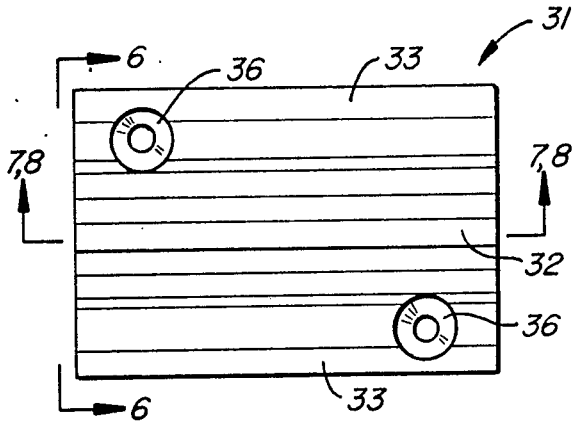
FIG. 5 is a top view of the embodiment of FIG. 4.

Referring to FIGS. 2 and 3, the ski tip receiver means 14 defines a generally cylindrical space 16 sized to receive in close co-axial relationship the tip 12 of a ski pole 13. While the cylindrical space 16 is shown having a circular cross-section, certain manufacturing methods may make a non-circular cross-section less expensive to make. The invention does not require that the cylindrical space 16 be circular in cross-section. What is required is that the ski pole tip fit snuggly in the receiver means so that it cannot rotate from a generally perpendicular orientation relative to the longitudinal axis of the ski. The tendency when carrying skis in the manner illustrated in FIG. 1 is to pull down on the shafts 17. Even for ski tips having a maximum diameter less than the minimum diameter of space 16, the baskets 18 prevent the skis from riding down the poles onto the skier.

The axis of cylindrical space 16 is oriented to be generally perpendicular to the longitudinal axis 19 of the ski and parallel to upper surface 11*c* so that when the pole tip 12 is inserted into the space 16, the ski poles 13 will remain under load conditions generally perpendicular to the longitudinal axis 19 of the skis.

The combination of rigidly maintaining space 16 perpendicular to the longitudinal axis of the skis and sizing space 16 to receive the tip of a ski pole permits the skis to be carried and maintained vertical, generally parallel to, and spaced from the back of a skier, as shown in FIG. 1.

If the ski pole tip receiver means 14 is not rigidly attached to the ski but rather rotatable or otherwise movable, the orientation of the space 16 and inserted tips, relative to the length of the ski, will be subject to moving away from perpendicular under load conditions resulting in the tail portions 21 of the skis tending to rotate into the lower body portion of the skier with the result of either dislodging the skis off of the ski poles or dislodging the skier off of his feet.

Ski tip receiver means 14 comprises a rigid cylindrical tube 23 defining cylindrical space 16 and integrally attach to a base plate attachment means 24 which is rigidly secured to the upper surface 11*c* of the ski as by a screw 26. The plate 24 can also be attached by epoxy or other adhesive with screw 26 or alone.

Referring to FIGS. 4–8, a preferred embodiment of the ski pole tip receiver 31 of the present invention comprises a unitary member formed by extrusion or other economical fabricating method which includes a cylindrical space defining section 32 disposed between flange sections 33 which are all integrally formed to define a flat base 34 which in operation is attached to the upper surface of a ski using an appropriate adhesive with or without screws for which screw holes 36 have been provided.

Figure 6:
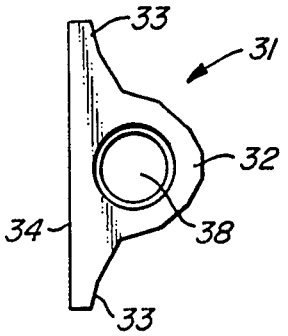
FIG. 6 is an end view taken along the line 6—6 of FIG. 5.
Figure 7:
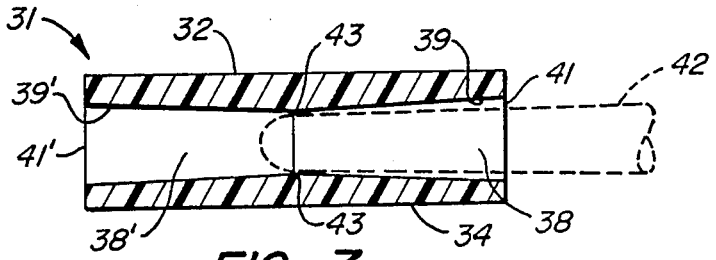
FIG. 7 is a section view taken along the line 7—7 of FIG. 5 with a portion of the ski pole tip disposed in the receiver.

As best seen by reference to FIGS. 6 and 7, a tapered cylindrical space 38 is defined by the internal walls 39 of the section 32. The space 38 is tapered inwardly from its opening 41.

A portion of a ski pole tip 42 is shown inserted into the ski pole tip receiver 31 and has a constant diameter (non-tapered) except at its very end portion which is rounded or tapered. The opening 41 of space 38 is larger than the diameter of ski pole tip portion 42 but space 38 tapers to a minimum diameter which is smaller than the diameter of tip 42. When the tip 42 is inserted into the receiver it will engage the walls 39 where they define a diameter 43 approximately equal to the diameter of the tip creating a frictional interference at 43 and thereby establishing a temporary connection between the receiver means and the ski pole tip.

Figure 8:
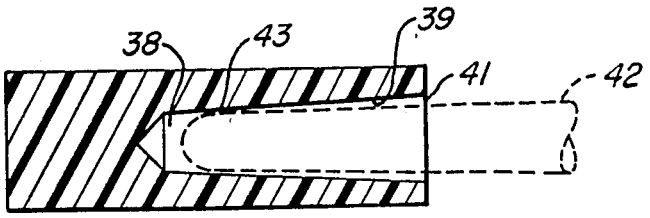
FIG. 8 is a sectional view taken along the line 8—8 of FIG. 5 and shows and alternative embodiment.

The embodiment illustrated in FIG. 8 is of a ski pole tip receiver defining a cylindrical space that extends completely through the receiver and includes in addition to the first cylindrical space 38, a second tapered cylindrical space 38' co-axial and co-extensive therewith and having an opening 41'. Ski pole tip 42 can be inserted into either opening 41 or 41' permitting the skis to be carried from either edge. It will be observed that a portion of the ski pole tip 42 extends into cylindrical space 38' which is one of the advantages of having the spaces co-axial and co-extensive.

The temporary connection formed by the frictional interference between the ski pole tip 42 and the interior walls 39 of the ski pole tip receiver 31 is sufficiently strong that if the ski pole handles are inadvertently permitted to rise above the ski pole tips while the skis are being carried in the manner shown in FIG. 1, the skis will not fall off of the ski pole tips.

At the present time, the vast majority of ski poles have ski pole tips of substantially identical dimensions and have a geometry substantially that illustrated in FIG. 7. There are, however, ski pole tips which are themselves tapered and there are others of substantially greater diameter. In the case where the ski pole tip is tapered along its entire length, it is only necessary that the opening 41 be of sufficient diameter and the taper at the correct angle to permit the ski pole tip to be inserted far enough into the receiver to permit a sufficient purchase between the receiver and the ski pole tip to permit carrying in the manner contemplated.

An alternative embodiment of the present invention (not shown) provides tapered cylindrical spaces 38 and 38' of different dimensions to be more universally acceptable to ski poles having tips of different diameters.

The temporary frictional connection between the ski pole tip and the ski pole carrier as described above can be easily and readily disconnected by simply twisting the ski pole as it is withdrawn.

Although all of the drawings illustrate the ski tip receiver means as being located at or forward of the ski binding toe piece, the invention is not so limited as location of the ski pole tip receiver elsewhere, such as aft of the heel portion of the ski binding results in the same advantages and permits the same carry method to be performed.

Since many modifications, changes and alterations may be contemplated in the teachings of the present invention by one skilled in the art, it is intended that the scope of the present invention only be limited by the following claims.

What is claimed is:

1. In combination with a snow ski having a top surface and a longitudinal axis, and a ski pole having a generally cylindrical tip portion, a ski carrier accessory comprising;

a ski pole tip receiver means rigidly and non-rotatably secured to the top surface of the ski, said means defining a generally cylindrical space sized to receive and retain the cylindrical ski pole tip portion in close co-axial relationship wherein the axis of the cylindrical space is generally perpendicular to the longitudinal axis of the ski and generally parallel to the top surface of the ski and wherein said ski pole tip receiver means is further described as having interior walls defining a first tapered cylindrical space including an opening into which a ski pole tip can be inserted wherein the diameter of the cylindrical space decreases from the opening inward to a diameter less than a diameter of the ski pole tip whereby a ski pole inserted into the opening of the cylindrical space will frictionally engage the defining walls of the cylindrical space forming a temporary connection between the receiver means and the ski pole tip, and whereby the ski pole is effectively secured to the ski at a right angle to the longitudinal axis of the ski which orients the ski generally vertically along a skier's back when the ski pole is supported on the skier's shoulder.

2. The ski pole tip receiver of claim 1 wherein said ski pole tip receiver has interior walls further defining a second tapered cylindrical space having an opening wherein the second tapered cylindrical space is co-axial with the first tapered cylindrical space and the diameter of the opening of the second cylindrical space is different than the diameter of the opening of the first cylindrical space.

3. The ski pole tip receiver of claim 1 wherein said ski pole tip receiver has interior walls further defining a second tapered cylindrical space having an opening wherein the second tapered cylindrical space is co-axial with the first tapered cylindrical space.

4. The ski pole tip receiver of claim 3 wherein the first and second tapered cylindrical spaces are of the same dimensions.

* * * * *